US006128903A

United States Patent [19]

Riege

[11] Patent Number: 6,128,903

[45] Date of Patent: Oct. 10, 2000

[54] SOLAR PORTABLE STEAM ENGINE

[76] Inventor: Carl Ralph Riege, 12217 Emelita St., No Hollywood, Calif. 91607

[21] Appl. No.: 09/347,741

[22] Filed: Jul. 6, 1999

Related U.S. Application Data

[60] Provisional application No. 60/100,044, Sep. 11, 1998.

[51] Int. Cl.[7] ..... B60K 16/00

[52] U.S. Cl. ..... 60/641.8; 60/641.15

[58] Field of Search ..... 60/641.8, 641.15, 60/398

[56] References Cited

U.S. PATENT DOCUMENTS 3,714,449 1/1973 De Bella ..... 290/1
3,959,056 5/1976 Caplan ..... 156/197
4,359,951 11/1982 Dauvergne ..... 110/234

*Primary Examiner*—Hoang Nguyen

[57] ABSTRACT

This Device is a simplified Solar Steam Engine. It consists of a sole reciprocating piston within a slotted cylinder. A piston actuating arm extends through the slot to provide the power take off. The Actuator Arm also provides the power to a slide valve (4) within an input/output (I/O) Manifold that directs the steam correspondingly to each end of the steam engine to move the piston back and forth. The actuator arm provides the power directly to a load such as a pump piston Which in turn also requires the back and forth movement to provide air pressure for air tools. water jet propulsion power could be provided for small boats like kayaks or canoes and the like. Even compression for Home-air conditioners may be possible.

4 Claims, 7 Drawing Sheets

PORTABLE SOLAR STEAM ENGINE

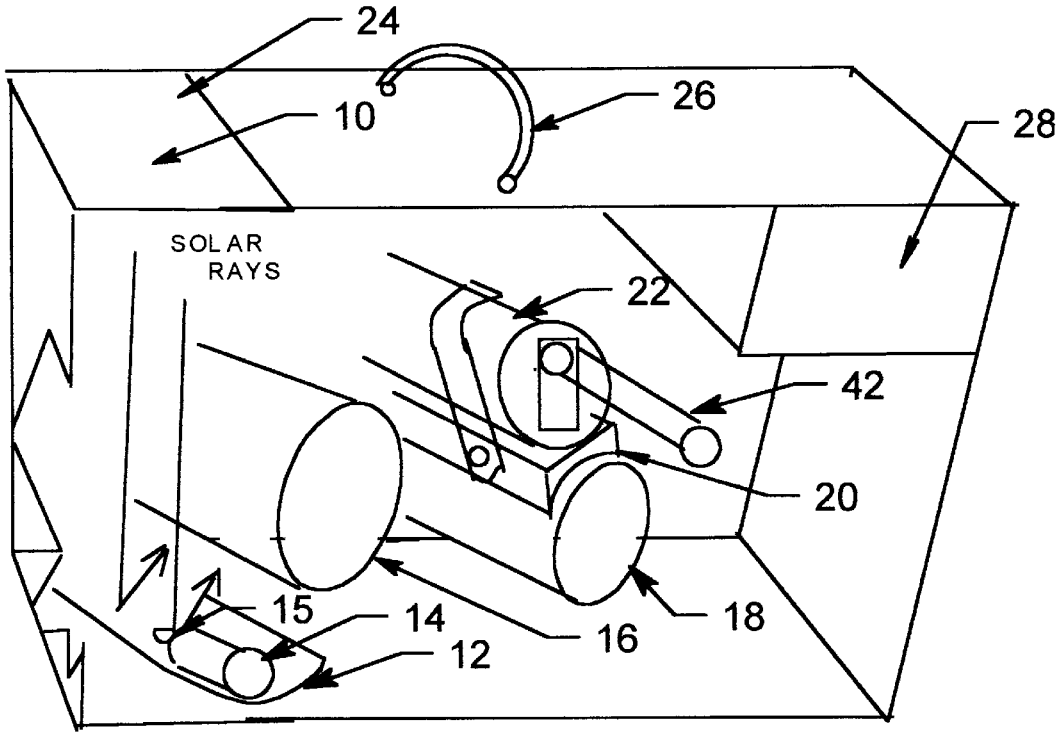
FIGURE 1 PORTABLE SOLAR STEAM ENGINE

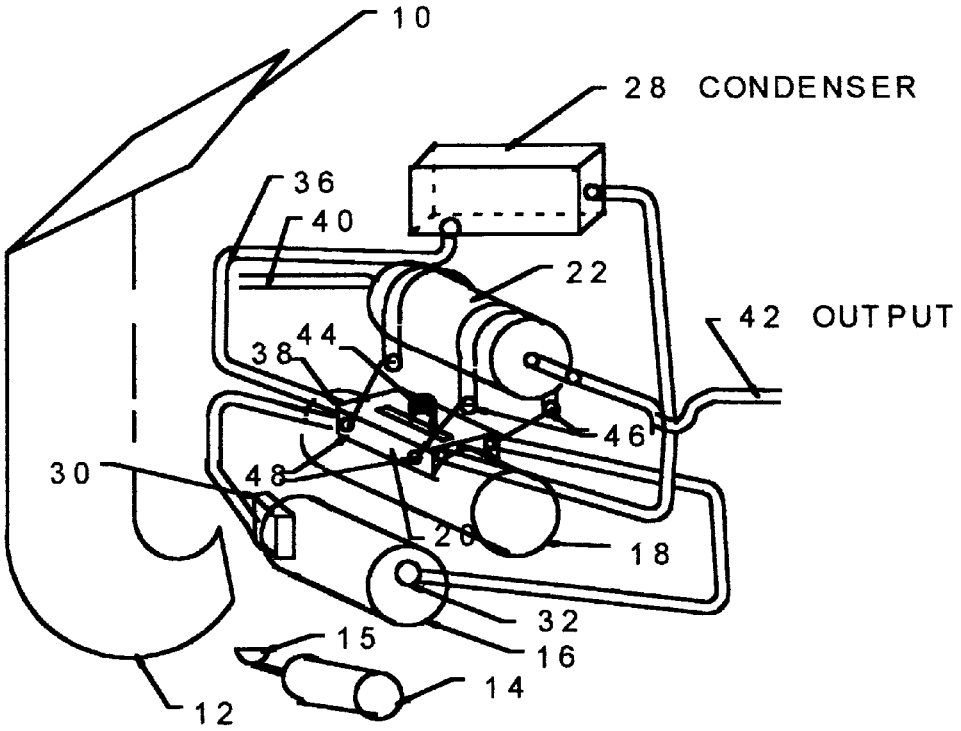
FIGURE 2 INTERCONNECTION DIAGRAM

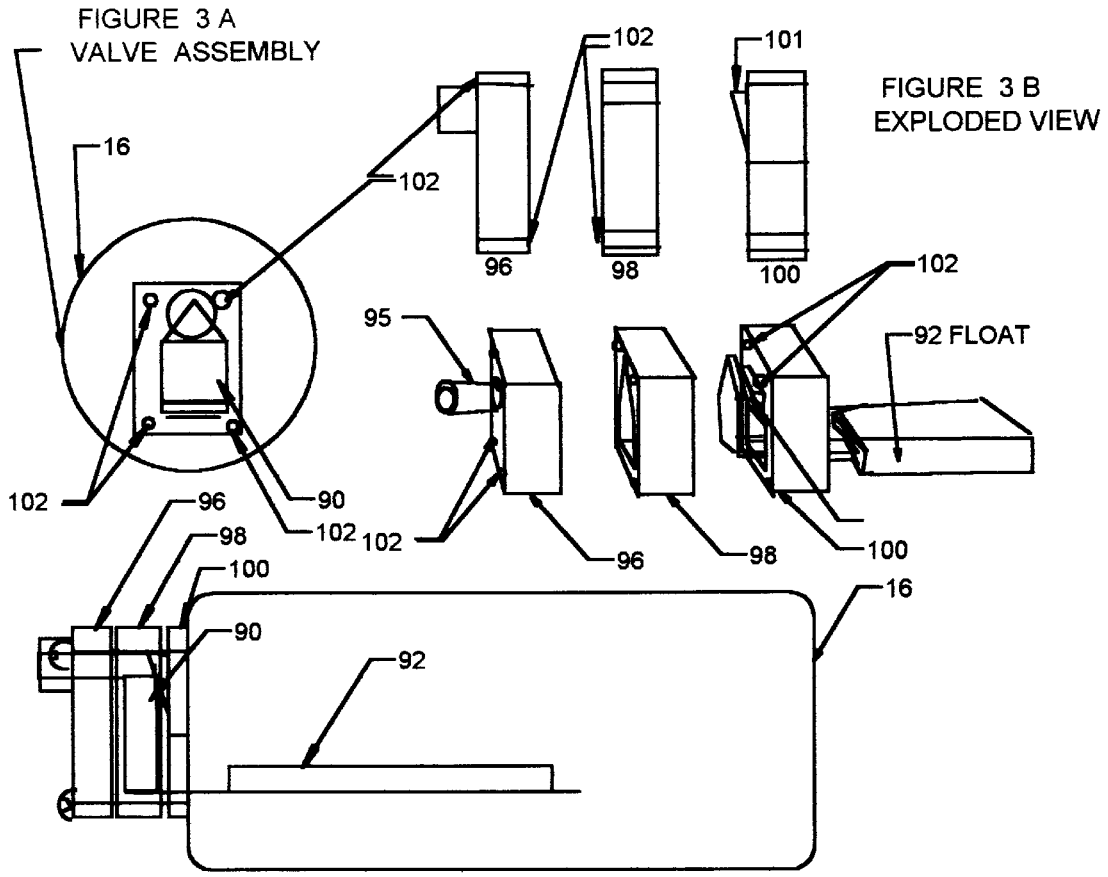
FIGURE 3 INJECTOR DETAILS

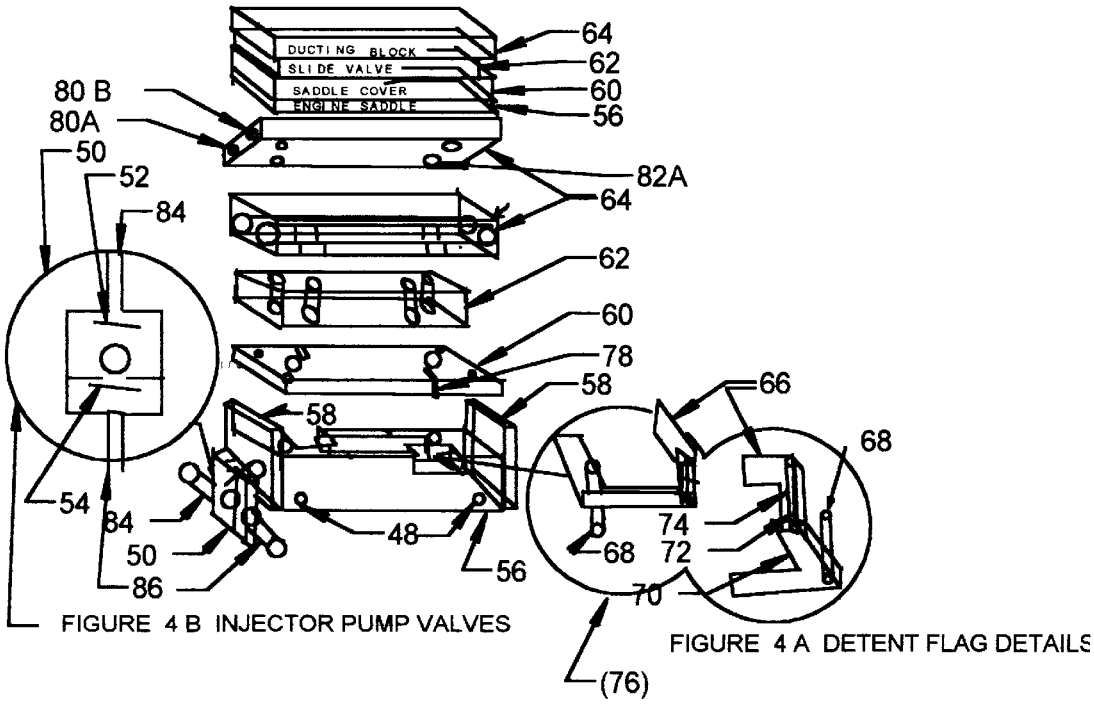
FIGURE 4 MANIFOLD ASSEMBLY

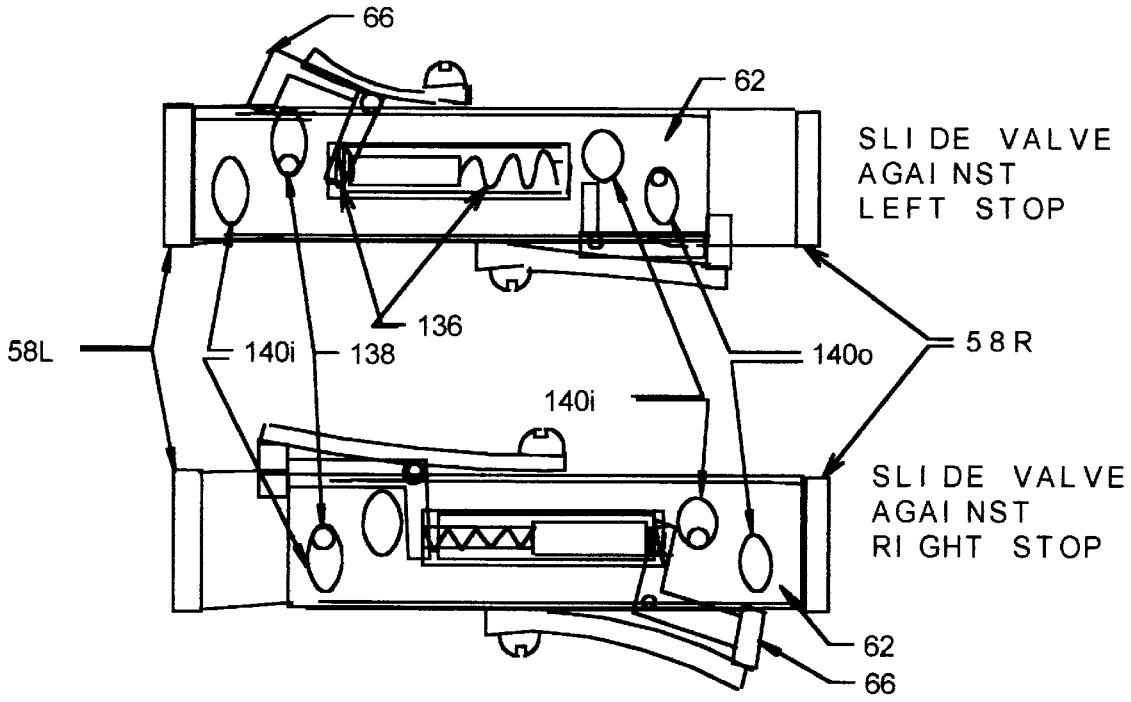
FIGURE 5 DETENT OPERATION

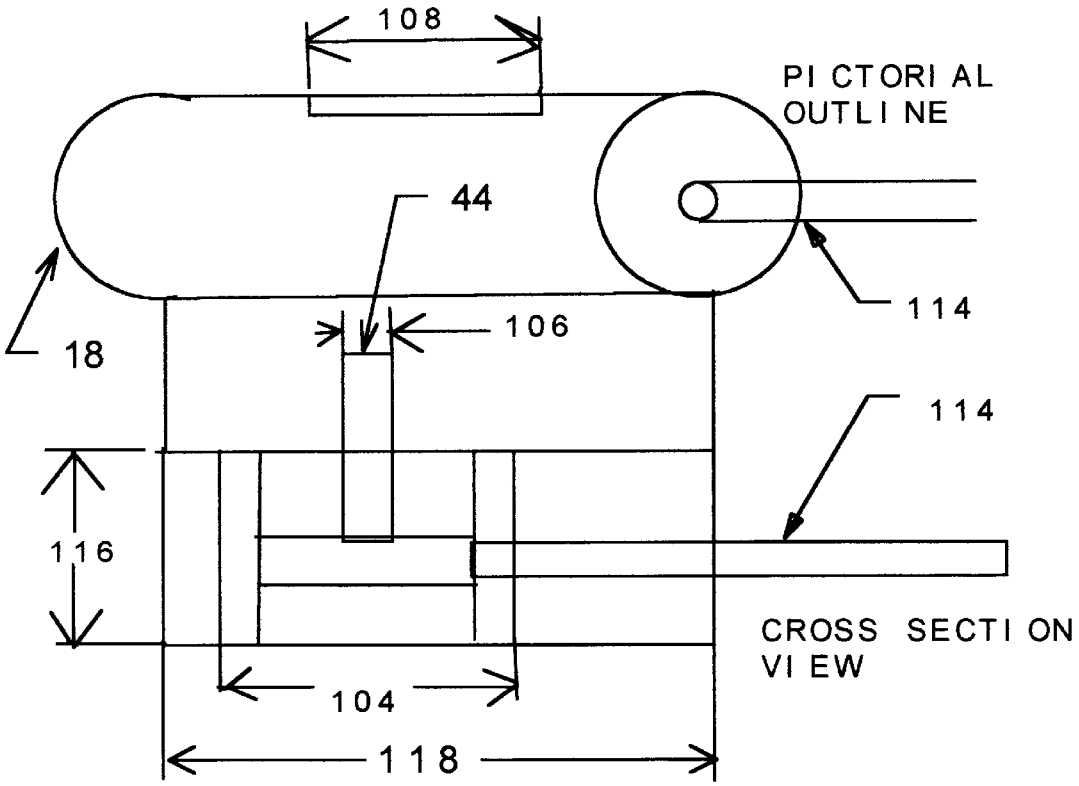
FIGURE 6 CRITICAL CALCULATION AREAS

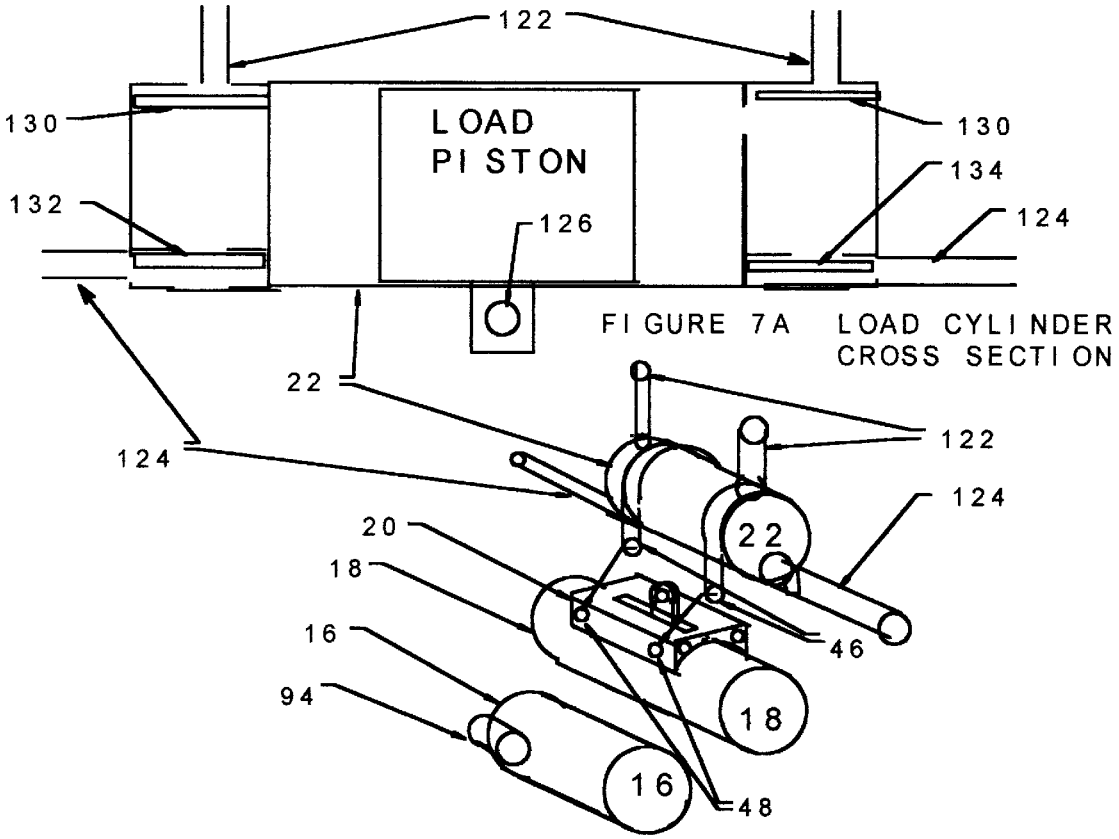
FIGURE 7A LOAD CYLINDER CROSS SECTION
FIGURE 7 SAMPLE LOAD

SOLAR PORTABLE STEAM ENGINE

Applicant hereby claims the benefit of provisional application Ser. No. 60/100,044 filed Sep. 11, 1998.

BACKGROUND OF THE INVENTION a. Related U.S. application Data:

| | Document # | Date | Name | Class | Subclass |
|---|---|---|---|---|---|
| 1 | 3,714,449 | 01-1973 | De Bella | 290 | 1 |
| 2 | 3,959,056 | 05-1976 | Caplan | 156 | 197 |
| 3 | 4,359,951 | 11-1982 | Dauvergne | 110 | 234 |
| 4 | 2969637 | 01-31-1961 | Richard J. Rowekamp | 60 | 26 |
| 5 | 3903700 | 09-09-1975 | Leonard Glickman | 60 | 641 |

b. on the international market, the author wants to note that solar efforts are being pursued at the Institute for Environmental Science, the Murdoch University, in Murdoch, Western Australia, 6150 under the name B/W Solar, (assumed trademarked in that country) that may apply, c. In addition, references researched under the following two databases (solar, energy) and (solar, Steam engines) resulted in a number of matches (namely over 120,000) too numerous to list.

1. Technical field

A brief survey of the solar energy field showed a preponderance of data available on "physically large"mechanisms. Publications are available, covering the Stanley Steamer up to and including the Titanic's steam propulsion mechanism. In the later years the photovoltaic electric generation covered this field.

2. Related Art

Is shown in the references cited, but none of the material seemed to cover the aspect addressed by this device. That of using the multiplication factor of the water-steam state change in a small portable unit would outperform the low conversion efficiency of the state of present art solar panels. In line with the present need for conservation of fuel and the constantly increasing stringent requirements for air pollution controls, This device is an attempt to provide solar generated power at low expense. This device attempts to convert solar energy with the least conversion loss to usable power. There is at the time of this writing no equivalent device on the market nor in publications. a brief search through the patent index did not highlight a similar approach. Although U.S. Pat. Nos. 2,969,637 by Rowekamp [Jun. 28, 1956] and 3,903,700 by Glickman [Dec. 20, 1973] are in this area, but are more complex and relate to fluids other than water and steam.

BRIEF SUMMARY OF THIS INVENTION

This device was invented for the purpose of using sun power in a compact mechanical unit. The device uses simplified steam generation and steam channeling mechanisms to save weight and complexity. The design uses the most direct method for mechanical interconnection. The load is of simplest and adaptable design. The device is of the most flexible use. The design of this device allows for the simple manufacturing techniques but does require corrosion resistant observance.

BRIEF DESCRIPTION OF THE DRAWINGS

The figures listed below illustrate both the possible use and the details of manufacture of the total concept:

FIG. 1 Total picture of this discovery shown in general outline form.

FIG. 2 the complete device in an interconnecting diagram

FIG. 3A Showing exploded view of the limit valve housing.

FIG. 3B Is the limiting valve assembly.

FIG. 4*a* Shows the detent flag detail

FIG. 4B Shows the injector pump valve housing.

FIG. 5 The pictorial of the slide valve positioning and flag detent operation FIG. 6 Critical calculation areas shown in line drawing definitions FIG. 7 Sample Load Pictorial showing possible mounting, with BI-valve action.

DETAILED DESCRIPTION OF THE INVENTION a. The primary goal of this discovery was aimed at providing a primary power source for driving loads such as gas pumps, fluid pumps, electric generators, and other such peripherals in areas where oil and gasoline fuels must be conserved. In fact devising the device to allow for solar energy use as well as Natural gas as well as possible charcoal and other simpler fuels in contrast to higher polycarbonates such as gasoline or crude oil as used in internal combustion engines.

b. FIGS. 1 and 2 show the general block Diagram and Interconnection Diagram of the total overall device. It consists of a steam generator (16) in which water is heated by solar radiation through a window (24). The solar energy is further concentrated by a Fresnel lens (10) and a concave mirror (12). The Fresnel Lens itself with the smooth side out, will act as the window pane (24). This concept is self-evident by the fact that a simple lens can be used to concentrate sunlight to start a fire. Feasability for this concept is covered later in this text under "Heat Calculations". This concept allows freedom to use any inflammable fuel (14) from candle wax to kerosene to natural gas or Propane through a Bunsen burner nozzle (15) to create the heat necessary for steam generation (16) and its associated pressure for the steam engine (18) for testing and in the absence of sunlight. The steam engine itself is deliberately designed in the most simple configuration of a free floating power piston with an output actuator arm (44) that can be directly attached to any load such as a pump piston (22). There are two critical mechanisms that will have to be designed based on empirical test data. One is the water injector subsystem (30) and the second is the I/O manifold and valve subsystem (20).

c. FIG. 2; This Figure illustrates the total concept in more detail. The solar heater is shown in caricature form as a Fresnel lens (10) with the smooth side out for easier cleaning and parabolic reflector (12) working in conjunction to collect and concentrate the sun light onto the steam generator (16). From where the steam (32) is piped to the input of the input/ output I/O manifold (20). The I/O manifold then passes the steam at the appropriate instance to the actuator piston in the engine, and then through the output (34) to an optional collector condenser (28) for recycling. The recycled water is collected and sent to the injector pump (50) for reinsertion into the Steam Generator. As the Actuator Arm moves with the engine piston back and forth, the actuator arm is inserted in the load piston. In this case the load pump piston then proceeds to pump whatever fluid is in the load pipeline. All interconnections can be completed with the standard taper fittings available for standard copper tubing. To conserve the water for steam generation a condenser is recommended on the exhaust output side and a return pipe (34) to the injector pump mechanism (50) on the manifold.

d. FIGS. 3 and 4 show more details of the critical injector subsystem. It must be understood that this subsystem is required to inject water into the Steam Generator (16) under the full steam pressure when needed and no more than needed. To perform this feat, this disclosure designed a graduated needle valve (90) arrangement based on the concept of automobile gasoline carburetors to control the gasoline flow input. This graduated needle valve sits on a float (92) at the water level in the Steam Generator. The cone angle will have to be determined empirically through tests on the various sizes of total systems match properly water inlet to steam generation requirements. To prevent the steam pressure from leaking out through the injector lines a one way ball input valve (95) was placed at the needle valve input. It is noted that water injector action is forced through the inlet pipes by the plunger tied to the I/O valve slide to produce an input spurt whenever the slide valve moves back and forth. When the injector needle valve prevents the water from entering the steam Generator, then a pressure relief valve (39) returns the water to the recycling Condenser (28).

e. FIGS. 4 and 5. Illustrate the second critical subsystem of this discovery. This is the manifold assembly subsystem sitting on top of the steam engine itself The action of this manifold is simple; it provides steam pressure at the correct time to the right and then to the left end of the tube designated the steam engine. At precisely the same moment the manifold allows the alternate end to exhaust to the condenser and recycling system. The movement of the slide valve is performed accurately by the engine piston actuator arm (FIG. 5; 44) by pushing the slide valve (62) against the right or left manifold stops (58). While the steam is let into the appropriate side port the slide valve is held in place by the flag detent mechanism in the center. The slide valve only has to move back and forth a small amount of distance from the inlet cutout (140 I) to the exhaust cutout (140 O) at each end of the engine housing for correct operation and placement. There is only one port hole at each end of the steam engine housing itself that serve both as inlet and exhaust depending upon the correct and corresponding position of the manifold slide valve slide. The elongated holes or Cutouts (140) through the slide Valve (62) connect the port hole either to the exhaust or to the pressure intake and the slide Valve is held in position against each saddle stop by the position spring and Flag detent (66) designed for this job. It should be noted that at each end of the slide there is one hole for connection to the exhaust line and one hole each elongated down to the intake manifold line. The distance is critical and shown as D between the engine port holes it is this distance that is duplicated exactly between each exhaust Cutout (140) on the slide and its corresponding intake Cutout at the other end of the slide. It is this critical distance that allows when flat against the right stop(58 R) to have the intake connected to the right end of the engine, while the left end has the exhaust line connected to the left engine port. At this time the engine floating-piston is pushed by the intake steam pressure to the left. The actuator arm (44) moves the slide valve (62) at the end of its travel past the position detent to the left reversing the manifold connections and therefore reversing the piston thrust and travel starting the whole cycle over again. It should be noted, that the final slide valve movement is performed by its two springs (136) in the slot in the center cutout. The right or left side spring is compressed during the actuator arm (44) movement; preventing the dead spot in the rotary steam engine where the piston crank rod is directly inline with the crankshaft. This action does require that the slide actuator slot (108) is longer than the width of the actuator arm (106), allowing the piston actuator arm to perform work as it travels back and forth.

FIG. 6 is presented to aid in defining of some of the dimensional connection and "Design Limitations".

f. FIG. 7 shows double action load cylinder above the manifold assembly. A single ended type of load would provide a pulsed output flow in synchronism with the steam Engine piston. The simple double acting load cylinder as shown would provide a steady stream of load fluid.

g. Definitions:

This mechanism inherently has some limitations that must be observed. And to understand them, the following definitions, with the associated abbreviations, are listed below:

1 (118) EL Engine Length the hollow length within the engine from the inside of one end cap to the inside of the other.

2 (104) PPW Power Piston Width The outside width of the piston inside the Engine from on end cap to the outside of the other end cap.

3 OVL overlap of the piston position on the right side to the position of the piston on the left side 4 TRVL travel of the piston inside the Engine.

5 FLG Flag that acts as detent to hold the valve slide fixed against The Manifold Saddle Stops.

6 DTTF the distance from the detent flag rotation pin to flag pole

7 DTAL the distance from the detent flag rotation pin to the point of contact of the actuator arm and the flag lever arm.

8 FLGL Detent flag length

9 (108) AASLT Actuator Arm Slot

10 (106) AAW Actuator Arm Width

11 EPD Engine Piston Diameter

12 LPD Load Piston Diameter

13 SSW Steam Seal Width h Calculations of engine design

The Engine is essentially a tube enclosed on each end by a sealed threaded end cap, and along the center a slot, open for the Actuator Arm (AA) to stick through for connection from the Power Piston to the Load Piston. To prevent loss of steam power past the power piston through the AASLT, The relationship of the Power Piston Width to the Slot are as follows.

1 The Power Piston must overlap as it moves from one end of the Engine to the other. The Overlap is:

$$OVL=2\times PPW-EL \qquad \text{eq 1}$$

2 The Overlap must be greater than the Actuator Arm Slot.

$$OVL>AASLT \qquad \text{eq 2}$$

3 But the Slot must accommodate the full length of the travel of the Power Piston, which is:

$$AASLT=TVL=EL-PPW \qquad \text{eq 3}$$

4 From the foregoing three equations one observes that:

OVL>AASLT or $$2\times PPW-EL>EL-PPW \quad \text{eq 4}$$

5 The overlap [OVL ] must be greater than the slot [AASLT] by the width of the actuator arm [AAW] plus a reasonable steam seal width [SSW] at each end of the slot; so that the equation can be written $$OVL=TVL+AAW+2SSW \quad \text{eq 5}$$

6 This allows the final designer of this machine to set up a five column table as follows:

| 1 | 2 | 3 | 4 | 5 |
|---|---|---|---|---|
| EL | PPW | OVL | TVL | AAW + 2SSW |
| | | 2PW-EL | EL-PPW | OVL-TVL |

And then dimensions to be used can be tested. The only criterion that aborts a choice is the one that creates a zero or negative number in the last column [5] because that would mean no room is provided for the actuator arm and seals.

i. Heat calculations: The amount of solar energy is listed in reference textbooks as approximately 2 small calories per square centimeter per minute. If therefore a lens or/and concave mirror combination is used of a square configuration of 10 cm on each side this would give us 10×10=100 cm squared area for collecting solar energy. This would total approximately 200 calories per minute aimed at the boiler for at least 6 to eight hours a day substantially without the use of a heliostat. This amount of heat would raise the temperature of one liter of water from say 10 degrees centigrade to boiling point of 100 degrees centigrade should take only a brief time. And from then on most of the energy would go toward generating the steam required to run the device at 40 calories per kilogram of water.

What is claimed is:

1. A portable solar power plant comprising:

a solar energy collecting means comprising a Fresnel lens in conjunction with a parabolic mirror and a pair of windows, one mounted on one side of the power plant and the other window mounted on top of the power plant, a steam generator being heated by entering solar energy in order to generate working fluid, an injector subsystem for injecting water into the steam generator, a steam engine being driven by the working fluid from the steam generator, a manifold assembly having a slide valve and an engine actuator arm to control said slide valve, a collector condenser connected with said manifold for recycling the working fluid, and a pump for returning said working fluid to said steam generator.

2. The portable solar power plant as described in claim 1 wherein the steam engine includes a free piston.

3. The portable solar power plant as described in claim 1 wherein the steam generator includes a graduated needle valve.

4. The portable solar power plant as described in claim 1 wherein the slide valve includes a flag detent mechanism.

* * * * *